United States Patent [19]

Swift

[11] Patent Number: 4,509,486

[45] Date of Patent: Apr. 9, 1985

[54] CONTINUOUS FLOW FUEL INJECTION SYSTEM

[76] Inventor: Joseph E. Swift, 47 Highview Rd., South Windsor, Conn. 06074

[21] Appl. No.: 489,792

[22] Filed: Apr. 29, 1983

[51] Int. Cl.[3] ..... F02M 39/00

[52] U.S. Cl. ..... 123/453; 123/459

[58] Field of Search ..... 123/446, 452, 453, 459, 123/462

[56] References Cited

U.S. PATENT DOCUMENTS

| | | | |
|---|---|---|---|
| 3,010,442 | 11/1961 | Hamilton | 123/453 |
| 3,029,800 | 4/1962 | Armstrong | 123/459 |
| 3,473,523 | 10/1969 | Hilborn | 123/446 |
| 3,739,762 | 6/1973 | Jackson | 123/452 |
| 4,171,099 | 10/1979 | Kopse et al. | 123/446 |
| 4,206,735 | 6/1980 | Miles et al. | 123/459 |

*Primary Examiner*—Magdalen Y. C. Moy

*Attorney, Agent, or Firm*—McCormick, Paulding & Huber

[57] ABSTRACT

A fuel supply system for an internal combustion engine continuously injects fuel into the intake air stream for each cylinder or other combustion zone. The fuel metering for each other combustion zone is performed by a metering unit individually serving that zone and responsive to a control pressure the value of which is dependent on various engine conditions so that the rate of fuel injection meets engine requirements. A cold idle feature provides an enhanced idle fuel rate of flow following start up of a cold engine. The system may be designed to retain system pressure for a long time after stopping the engine to prevent vapor lock and there are no atmospheric vents anywhere in the system so there are no evaporative emissions to contend with during running or shut down of the system.

16 Claims, 16 Drawing Figures

CONTINUOUS FLOW FUEL INJECTION SYSTEM

BACKGROUND OF THE INVENTION

This invention relates to a fuel injection system for an internal combustion engine and deals more particularly with such a system wherein fuel for each cylinder or other combustion zone is continuously injected into the induction air stream for that cylinder or zone for mixing of the fuel with the air prior to and during the entry of the air into the cylinder or other combustion zone. Continuous flow injection systems of the general type with which this invention are concerned are shown, for example, by U.S. Pat. Nos. Re. 25,672 and Re. 25,701.

The general aim of this invention is to provide a continuous flow fuel injection system improved in comparison to those available or proposed in the past.

A more particular object of the invention is to provide a continuous flow fuel injection system made up of a number of units of straight-forward, reliable construction providing a long maintenance-free service life for the system.

A further object is to provide a system of the foregoing character wherein fuel injection for each combustion zone is provided by a metering unit individually associated with that zone and wherein fuel to be injected is supplied to that metering unit at a constant pressure with the metering unit including a metering valve positioned by a control pressure the value of which represents engine requirements, the rate of fuel injection from the metering unit therefore being entirely dependent on the position of its valve element.

Further objects of the invention are to provide a system of the foregoing character which may be designed to retain system pressure for a considerable time after stopping the engine so as to avoid vapor lock and which system includes no atmospheric vents thereby avoiding evaporative emissions both during engine running and shut down.

SUMMARY OF THE INVENTION

The invention resides in a continuous flow fuel injection system for an internal combustion engine wherein fuel is injected into the air induction stream for each cylinder or other combustion zone by a metering unit individually associated with the zone with the fuel to be injected being supplied to the metering unit at a constant pressure and with the metering unit having a valve element positioned in response to fuel pressure supplied to the metering unit at a control pressure dependent on engine requirements.

The invention more specifically resides in the control pressure supplied to each metering unit being obtained by flowing fuel from a substantially constant pressure supply through a fixed orifice to a control pressure chamber so that the pressure in the control pressure chamber varies with the rate of flow, and further by controlling the rate of such flow in response to the accelerator position and the manifold vacuum.

The invention still further resides in the rate of flow through the aforesaid orifice being determined by a control pressure regulator having an orifice with a variable spill area determined by a tapered valve member in the orifice the position of which valve member is determined both by the manifold vacuum and by fuel having a pressure dependent on the accelerator position.

The invention also resides in various units used to obtain the control pressure being force balance spill and fill type units using only fuel at different pressures and the manifold vacuum, with the spilled fuel being returned to the tank, the system including no atmospheric vents able to produce evaporative fuel emissions.

DETAILED DESCRIPTION OF THE PREFERRED EMBODIMENTS

Figure 1:
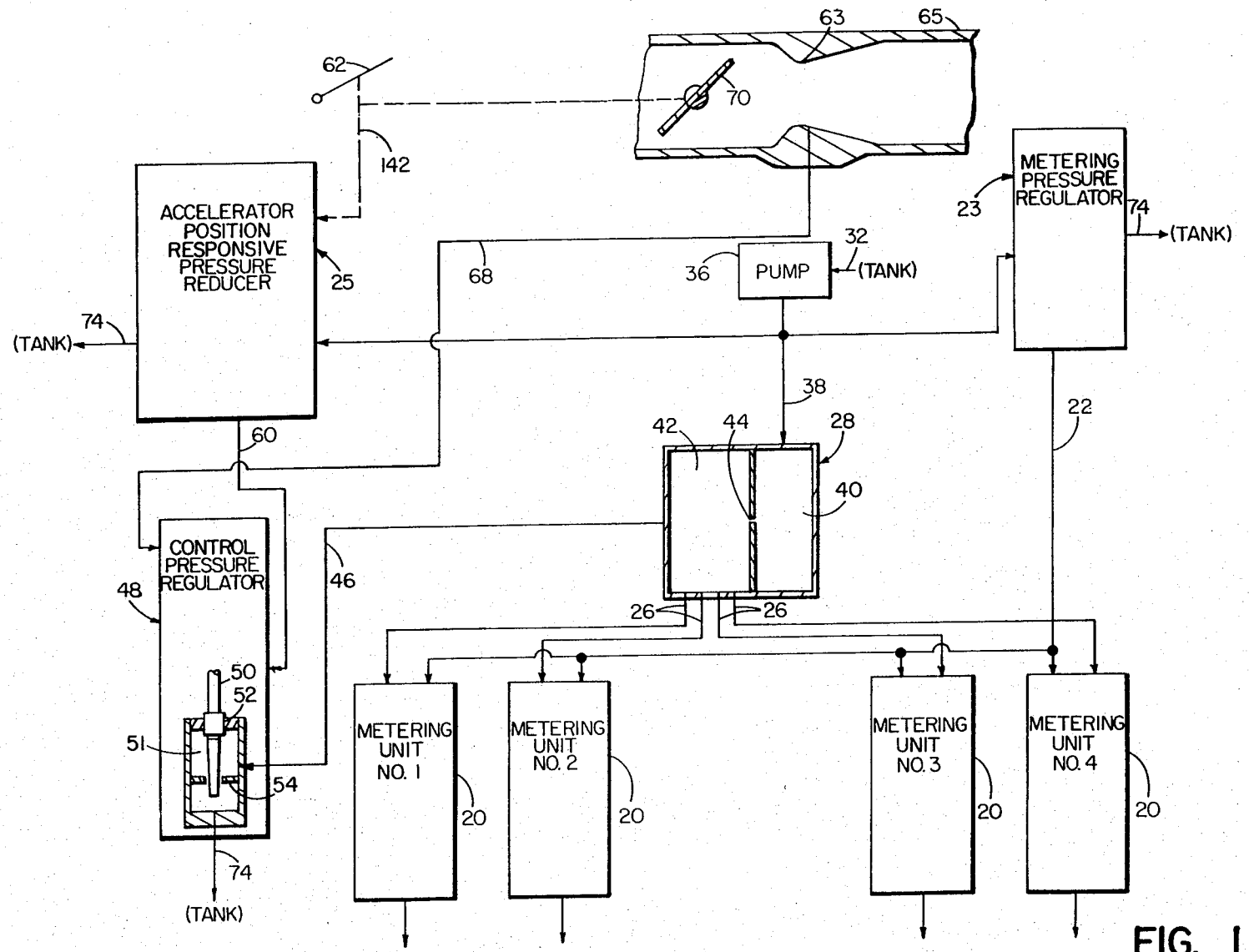
FIG. 1 is a block diagram showing a system embodying this invention applied to a four cylinder engine.
Figure 2:
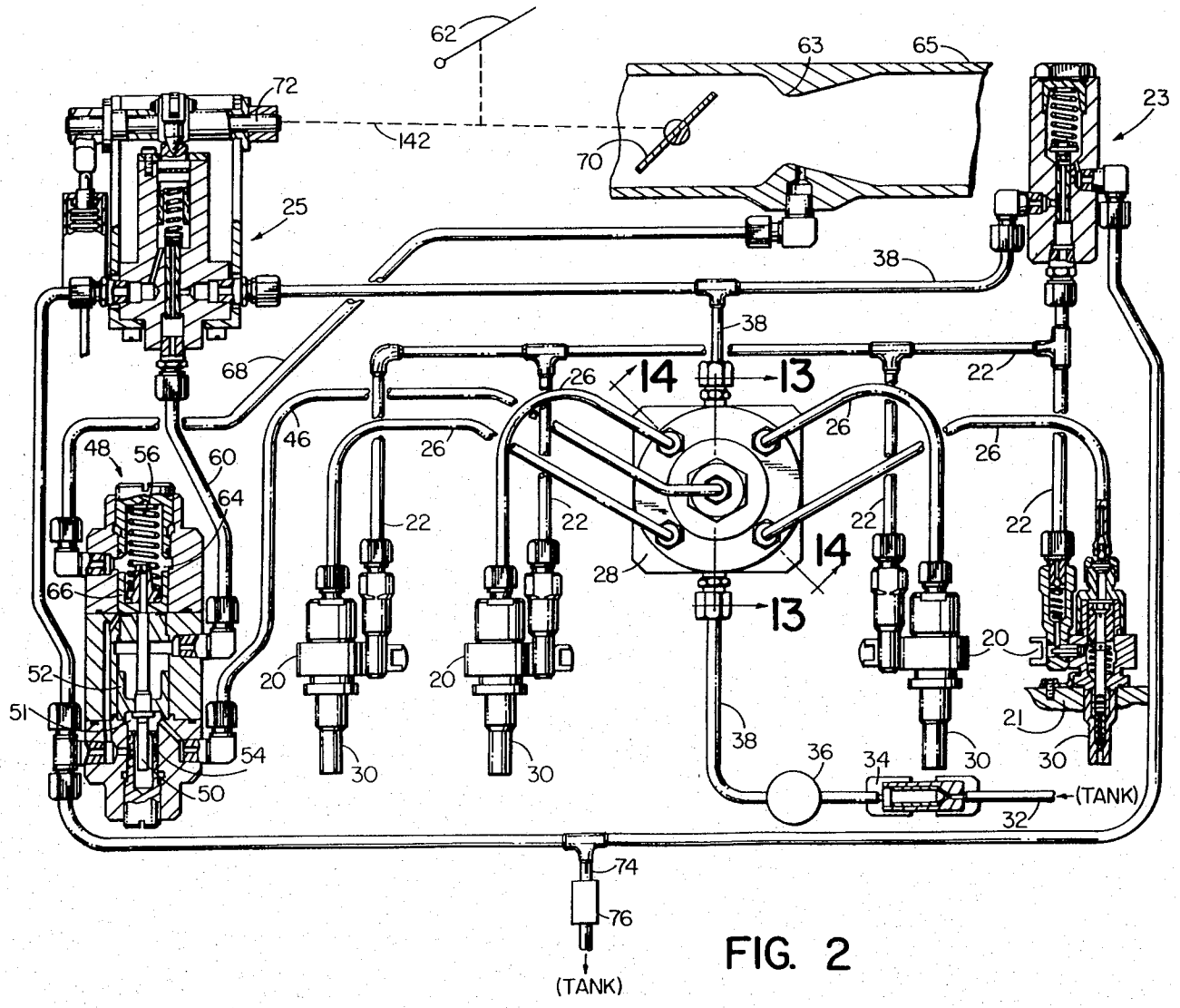
FIG. 2 is a schematic diagram showing the system of FIG. 1 in more detail.

General Organization—FIGS. 1 and 2

By way of example, FIGS. 1 and 2 show, in block diagram and schematic form respectively, a continuous flow fuel injection system embodying the present invention and designed for use with a four cylinder reciprocating internal combusion engine using gasoline as its fuel. However, the invention is not necessarily limited to a reciprocating engine or to a reciprocating engine with any particular number of cylinders or to the use of gasoline as the fuel. Instead, the general principles of the invention may be used with reciprocating engines of any number of cylinders, or with turbine engines, where the injection mode is continuous flow and they may also be used with gasoline or any other suitable liquid fuel.

Referring to FIGS. 1 and 2, a fuel metering or injection unit 20 is provided for each of the four cylinders of the engine and is located as close as possible to the intake valve of the associated cylinder. Where feasible, each metering unit 20 is preferably installed in the cylinder head 21 in the air induction passage just upstream of its associated intake valve. Where this location is not possible it may be mounted in a duct of the intake manifold. In either case, fuel is sprayed from the lower end of each metering unit 20 into the induction air stream of the associated cylinder and is blended with the air stream as both constituents of the mixture pass through the intake valve and into the cylinder.

Each fuel metering or injection unit 20 meters—that is, controls the flow rate of—fuel supplied to the associated cylinder. The injected fuel is supplied to the metering unit by an intermediate pressure supply line 22 maintained at a constant pressure by a metering pressure regulator 23. The constant pressure selected for the intermediate supply line 22 may vary, but preferably it is about 40 to 45 p.s.i.

Since the fuel supplied to each metering unit 20 is supplied at a constant pressure the flow rate of the fuel discharged from each metering unit is adjusted by a movable valve member as explained in more detail hereinafter. The positioning of the valve member to control the flow rate is determined by the pressure (referred to as the "control pressure") of fuel supplied to the metering unit by a control pressure line 26 connected to a control pressure distributor 28, with all four of the control pressure lines 26, 26 being supplied with the same pressure from the distributor 28. As the control pressure supplied by a line 26 to its metering unit 20 increases the flow rate of the fuel discharged from the unit's lower end 30 increases and as the control pressure decreases the flow rate of the discharged fuel likewise decreases.

Fuel is withdrawn from the tank (not shown) through a line 32 and check valve 34 by a pump 36. The pump 36 supplies fuel at a substantially constant high pressure, for example 65 to 70 p.s.i., to a high pressure supply line 38. The high pressure supply line is connected to the control pressure distributor 28 and also passes through the distributor as shown in FIG. 2. Beyond the distributor 28, in FIG. 2, the high pressure supply line is connected to, and supplies, the metering pressure regulator 23 and an accelerator position responsive pressure reducing unit 25.

As shown best in FIG. 1, the distributor 28 includes a first chamber 40 and a second chamber 42 separated by a fixed diameter pressure dropping or throttling orifice 44. The high pressure supply line 38 is connected to the chamber 40, and connected to the chamber 42 are the four control pressure lines 26, 26 and a regulating line 46. Flow through the regulating line 46 is in turn controlled by a control pressure regulator 48. The rate at which fuel is permitted to flow through the line 46 by the regulator 48 determines the pressure in the chamber 42 and in the control pressure lines 26, 26. That is, the greater the flow in the line 46 the greater will be the flow through the orifice 44 and the greater will be the pressure drop across the orifice and, since the pressure in the chamber 40 is constant, the lower will be the pressure in the chamber 42.

As shown in FIG. 1, the control pressure regulator 48 essentially includes a movable valve member 50 having a tapered or frusto-conical lower end received in and cooperating with an orifice 54 so that the vertical position of the tapered lower end determines the rate of flow in the line 46. The prime forces acting on the positioning of the member 50 are: (a) the control pressure supplied by the line 46 to a chamber 51 in the regulator 48 and wherein the control pressure is applied to the lower face of a lower piston 52 fixed to the member 50, and (b) the force of a spring 56 urging the member 50 and the piston 52 downwardly against the force exerted on the piston by the control pressure in the chamber 51. These two forces, the force of the control pressure and the force of the spring 56 on the member 50 determine a basic position for the tapered lower end of the member 50, and accordingly determine a basic spill area for the orifice 54.

In the control pressure regulator 48 the position of the valve member 50, and accordingly the value of the spill area of the orifice 54, is further modified in accordance with varying requirements in engine speed and/or load as described below. First, the position of the tapered lowered end of the valve member 50, relative to the orifice 54 is further affected by a "biasing" pressure supplied by the unit 25 operated by the accelerator pedal 62. As previously mentioned, the unit 25 is essentially a pressure reducer responsive to the accelerator pedal position. The input to the unit 25 is fuel at the high pressure of the supply line 38 and its output is fuel at a reduced ("biasing") pressure supplied to an output line 60 connected to the control pressure regulator 48. Depressing the accelerator pedal increases the "biasing" pressure in the line 60 which pressure acts on the top face of the lower piston 52 of the regulator 48. This "biasing" pressure is minimum at idle speed and increases progressively with pedal displacement from the idle position. The effect of this is a variable biasing force which opposes the upward force on the lower piston 52 and which increases with increases in the accelerator displacement. Because of this, the position of the tapered lower end of the valve member 50 in the orifice 54, and consequently the control pressure appearing in the chamber 51, is proportional to the accelerator position. The accelerator position is therefore a speed signal.

An additional biasing effect supplied to the regulator 48 is obtained by applying vacuum appearing at the venturi 63 of the manifold 65 to a chamber 64 above an upper piston 66 also fixed to the valve member 50. In effect, the vacuum supplied by the line 68 opposes the force of the spring 56 and negates a portion of it. Thus, the vacuum force becomes another force influencing the position of the member 50 and modifies the effect of the other forces acting on it. The vacuum provides a positioning effect which is proportional to the engine load, with high vacuum (corresponding to low load) tending to increase the spill area of the orifice 54, by tending to raise the valve member 50, and therefore tending to reduce the control pressure in the chamber 51.

As described above, there are therefore two variable forces imposed on the valve member 50 of the regulator 48: one developed by a variable fuel pressure under control of the accelerator pedal 62 which is in effect a speed signal and another produced by the vacuum from the intake manifold 65 which constitutes a load signal. By means of these two variable forces acting in conjunction with a control pressure force and a spring force, the position of the tapered lower end of the valve member 50 in the orifice 54 is made to respond to any combination of engine speed and load. The positioning of the valve member in turn modifies the spill area of the orifice 54 and precisely regulates the control pressure appearing in the chamber 51, in the line 46, in the chamber 42 of the control pressure distributor 28 and in the control pressure lines 26, 26 applying fuel at the control pressure to the metering units 20, 20. Essentially the utilization of speed and load signals in this way helps to maintain a stoichiometric ratio of fuel and air and therby minimizes exhaust emissions.

It is necessary to maintain this ideal "combining" ratio for any steady-state condition of operation in a gasoline fueled internal combustion engine. Deviation from this condition is permissible only during transient periods of acceleration when enrichment is necessary to temporarily increase power. Alternatively, deviation from this condition can be accepted during lower power demand, such as during deceleration, when a leaner more economical mixture can be tolerated briefly.

Therefore, with the system of this invention as described above, as the manifold air opening determined by the throttle plate 70 is reduced at part load and manifold vacuum increases, so too is the rate of injection of fuel from each of the metering units 20, 20 also reduced. The extent of such fuel injection flow rate reduction is controlled by the manifold vacuum which is impressed on the upper face of the piston 66 of the control pressure regulator, causing the regulator to compensate for changes in the manifold vacuum and thus to automatically adjust the fuel/air ratio as engine operating conditions vary.

The manifold vacuum also functions in a reverse sense during acceleration. In this case, a sudden reduction of vacuum supplied to the control pressure regulator 48 upper piston 66, along with an increase of biasing pressure supplied by the control unit 25, due to a physical manipulation or opening of the throttle plate 70 caused by pressing down the accelerator pedal 62, combine to temporarily enrich the fuel/air mixture and provide increased power for acceleration. When the speed again stabilizes at a higher level, the manifold vacuum again increases somewhat and acts to "trim" the fuel delivery in accordance with the new operating conditions.

As mentioned, the system described above is pressurized by the pump 36 which is preferably a variable displacement vane type pump, such as shown by my copending patent application Ser. No. 476,104, filed Mar. 17, 1983 and now U.S. Pat. No. 4,477,231. That is, the pump 36 is one which is pressure compensated insofar as when operating pressure is reached the pump inherently varies its output or delivery rate, maintaining just enough delivery to satisfy the demands of the system and to sustain a substantially constant operating pressure. The pump is driven by an electric motor (not shown) which has system voltage applied to it through an oil pressure switch when the ignition switch is on and the engine lubricating system is pressurized. A shunt circuit which is activated by the starting switch bypasses the oil pressure switch while the engine is being cranked. This makes it possible for the fuel pump to run before the oil pressure switch closes. After the engine starts and the key switch is moved from "start" to "run", the shunt circuit is deactivated. Lubricating oil pressure is then available, closing the pressure switch which then assumes the task of providing current for fuel pump 36. The shunt circuit is utilized only during cranking and makes it possible to pressurize the fuel system before lubricating oil pressure is available to activate the pressure switch. There is an inherent safety feature in this arrangement in the sense that, should the engine stall while running unattended, the fuel pump will stop as soon as the engine comes to a standstill. This will prevent flooding the engine with gasoline. Another and less obvious benefit of this safety circuit is the fact that in the event of loss of lubricating oil pressure, the fuel pump will stop, thus shutting down the engine and preventing damage due to loss of lubrication.

The discharge pressure of the pump 36 may for example be 65 to 75 p.s.i. Fuel at this pressure is supplied by the high pressure line 38 to the metering pressure regulator 23 which is basically a pressure reducing valve supplying fuel at a constant output pressure of about 40 to 45 p.s.i. to the intermediate pressure line 22 for use by the metering or injection units 20, 20 which inject it into the associated engine air induction passages. The pressurized fuel of line 38 is also supplied to the control unit 25 which is also basically a reducing valve but is capable of varying its discharge pressure, appearing on the line 60, for example from 16 to 52 p.s.i., with the value of such discharge pressure being dependent on the accelerator pedal position.

The throttle plate 70, the accelerator pedal 62 and the control shaft 72 of the control unit 25 are mechanically connected for movement in unison so that for each position of the accelerator pedal 62 there is a corresponding position for the throttle plate 70 and for the control shaft 72. Due to the relative sizes of the parts involved there is a reduction of angular displacement between the throttle plate 70 and the control unit shaft 72. That is, as the throttle plate 70 moves through a given angular distance the shaft 72 moves through a corresponding lesser angular displacement, but in any case the movement of the throttle plate 70 and the movement of the shaft 72 remain fixed ratios of accelerator pedal movement at all times, except during a cold idle condition as explained hereinafter.

A feature of the system is its pressure retention capability. By means of this, it is possible to hold the system pressure for a considerable time after stopping the engine. Pressure is confined in the metering units 20, 20 by the closure of their metering valves. Additionally, the check valve 34 in the suction line 32 to the pump 36 closes when the pump stops, confining pressure in the pump and the distribution lines. Further, the return line 74 is sealed by an electrically operated valve 76 having a solenoid which is energized to open the valve when the ignition switch is turned on. When the ignition switch is turned off, the solenoid of the valve 76 is deenergized allowing a spring to close the valve sealing the return line 74 against any siphoning effect which might drain the system. Thus the system is completely sealed at shut off and retains sufficient pressure to prevent vapor lock which might otherwise occur as, for example, after a hard run in hot weather.

From the foregoing it will be understood that the units 23, 25 and 48 are all flow-through type ones wherein the pressure reducing or regulating effect achieved by the unit involves a certain amount of "spill over" or flow through of liquid fuel to the return line 74. However, a feature of the system is that there are no atmospheric vents anywhere in the system and there are accordingly no evaporated emissions to contend with while the system is running or after it is shut down. When the engine is running, the return fuel flow is conveyed by the return line 74 back to the fuel tank which is also sealed against vapor loss, thus making the entire fuel system both liquid and vapor tight.

Figure 3:
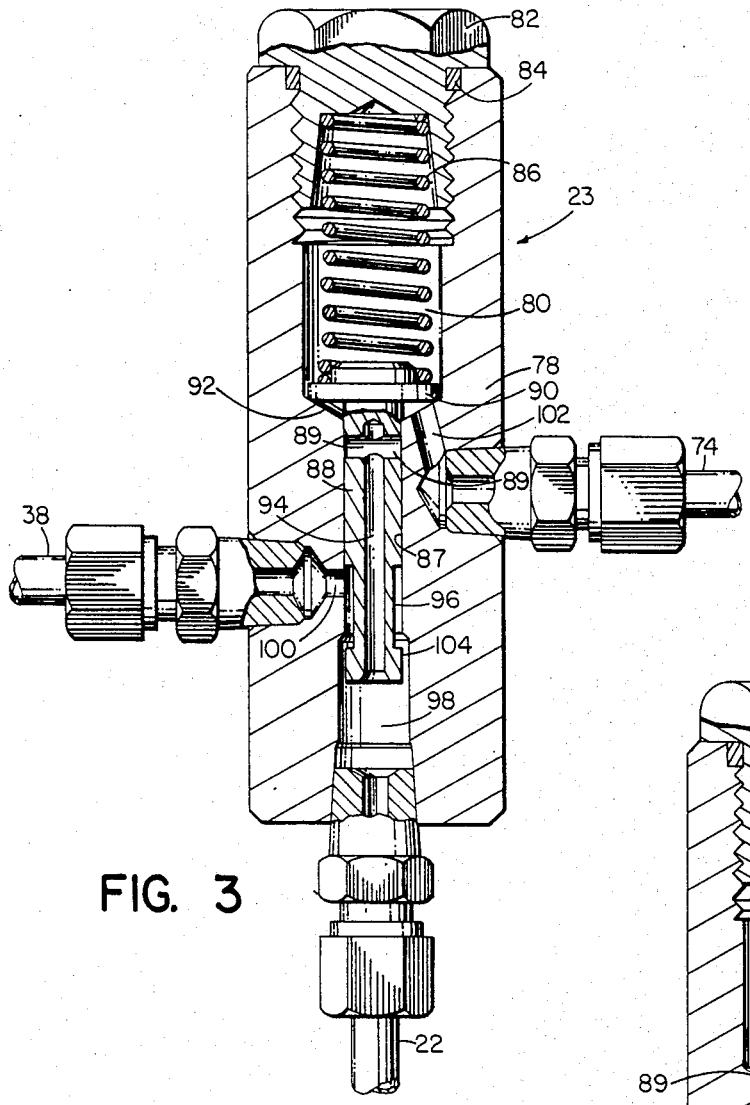
FIG. 3 is a vertical sectional view taken through the metering pressure regulator of FIG. 2 with this view showing the parts of the unit in the fill mode.
Figure 4:
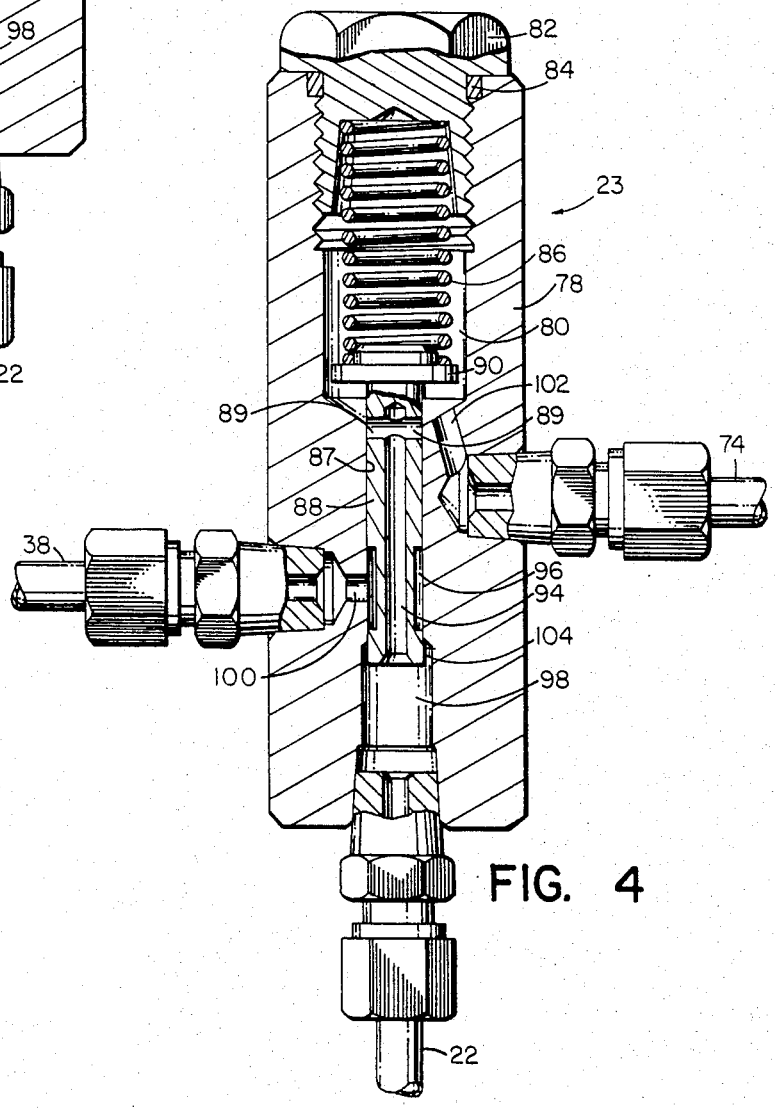
FIG. 4 is similar to FIG. 3 but shows the parts of the unit in the spill mode.

Metering Pressure Regulator—FIGS. 3 and 4

The construction of the metering pressure regulator 23 of FIGS. 1 and 2 is shown in more detail in FIGS. 3 and 4. Referring to these figures, this unit includes a body 78 having an upper chamber 80, closed at its upper end by a threaded plug 82 and seal 84, receiving a spring 86. A cylindrical valve member 88 is supported for vertical sliding movement by a bore 87 in the body 78 and has at its upper end an enlarged diameter disc-shaped portion 90. The spring 86 engages the upper face of the disc portion 90 and urges it and the remainder of the valve member 88 downwardly toward the position shown in FIG. 3 at which the disc portion 90 engages the conical bottom end surface 92 of the chamber 80. The valve member 88 includes a spill passageway 94 which extends from the very bottom of the member 88 to a point slightly below the disc portion 90 at which point it extends transversely through the member 88 to communicate with the side surface of the member 88 at two diametrically opposite ports 89, 89. Spaced a short distance upwardly from its lower end, and on its outside surface, the member 88 includes a reduced diameter portion forming an annular chamber 96 with bore 87. The lower end of the valve member 88 resides in a lower or outlet chamber 98 having a diameter somewhat larger than that of the bore 87.

The high pressure supply line 38 is connected to the body 78 by a suitable fitting and communicates with the annular chamber 96 through a passageway 100. The output or intermediate pressure line 22 is connected to the lower end of the body 78 and communicates with the outlet chamber 98. The tank or return line 74 is also connected to the body 78 by a suitable fitting and communicates with a passageway 102 leading to the lower end of the chamber 80.

The unit 23 is basically a pressure-reducing valve and as such is self-regulating in terms of flow rate. It will, as engine requirements demand, adjust its rate of flow to the line 22 so as to maintain a substantially constant pressure in that line even though the engine requirements might vary from idle fuel quantity to full load fuel delivery.

In the operation of the unit 23, fuel enters the unit at full pump discharge pressure through the line 38 and fills the annular chamber 96. If the pressure in the outlet chamber 98 is such that the device is in the "fill" mode, the lower end of the annular chamber 96 will be in communication with the outlet chamber 98 and line 22, as shown in FIG. 3. Under these conditions, the valve member 88 is held in its down position, as shown in FIG. 3, by the spring 86 and fuel from the high pressure supply line 38 will have access to the intermediate pressure line 22 through the chamber 98.

The pressure in the chamber 98 acts to impose an upward force on the lower end of the valve member 88 and as the pressure in the chamber 98 approaches the designed value, it progressively overcomes the downward force of the spring 86, urging the valve member 88 upwardly in the bore 87. As the designed pressure is reached in the chamber 98, the annular land 104 on the lower end of the valve member 88 enters the lower end of the bore 87 as shown in FIG. 4. This effectively seals off any further ingress of fuel from the high pressure line 38 to the chamber 98.

Simultaneously with the closure of fuel admission from the line 38 to the outlet chamber 98 the ports 89, 89 of the spill passageway 94 in the valve member 88 move upwardly out of the housing bore and provide communication between the upper chamber 80 and the outlet chamber 98. Since the upper chamber is vented back to the fuel tank through the return line 74, the opening of the spill passageway 94 to this chamber relieves pressure in the output chamber 98, and the spilled fuel is conducted back to the tank by the line 74.

FIG. 3 shows the unit 23 in the "fill mode" or condition at which the outlet chamber 98 is below the designed output pressure and is therefore filling with pressurized fluid from the line 38. FIG. 4 shows the unit 23 in the "spill" mode at which the pressure in the outlet chamber 98 is above the designed pressure and therefore the valve member 88 is lifted to permit the relief of pressure in the chamber 98 by flow of fuel from that chamber through the spill passageway 94 to the vent or tank line 74.

Actually, the unit 23 is one utilizing a force balance and in normal operation the valve member 88 hovers between the fill mode of FIG. 3 and the spill mode of FIG. 4 to maintain a substantially constant pressure in the outlet chamber 98 and in the attached intermediate pressure line 22.

Accelerator Position Responsive Pressure Reducer—FIGS. 5 to 11

As explained above the accelerator position responsive pressure reducer 25 is basically a pressure reducing valve. It accepts fuel at the high delivery pressure of the line 38 and modifies this to a value, dependent on the accelerator position, delivered to the outlet line 60 for use as a "biasing" force by the control pressure regulator 48. Spilled fuel produced in achieving the pressure reducing function is returned to the tank through the return line 74.

Figure 5:
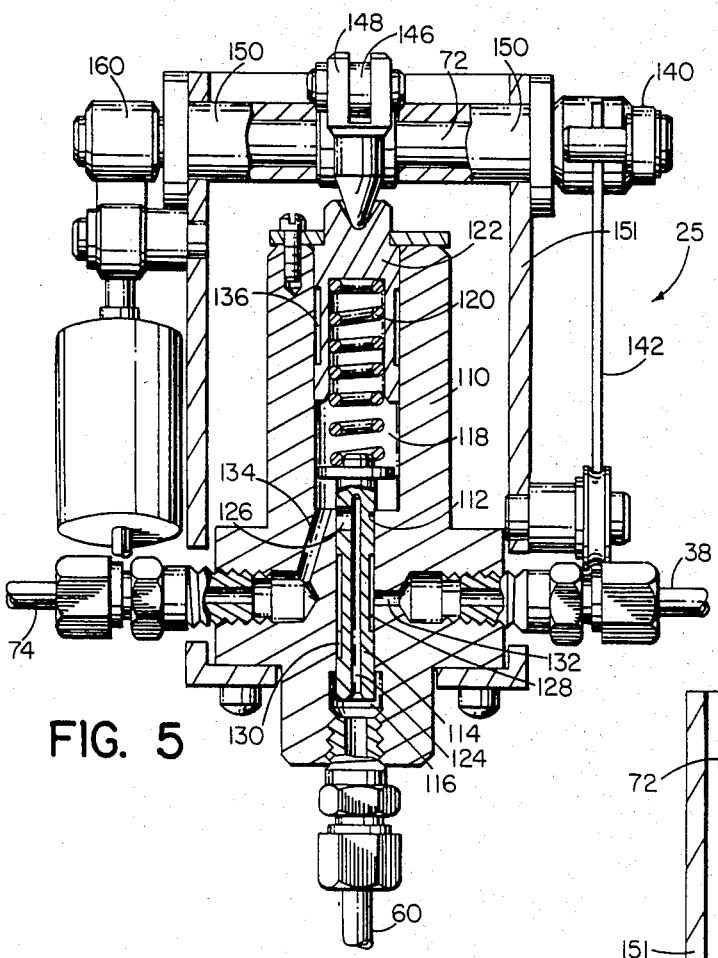
FIG. 5 is a vertical sectional view, taken generally on the line 5—5 of FIG. 6, of the accelerator position responsive pressure reducer of FIG. 2.
Figure 6:
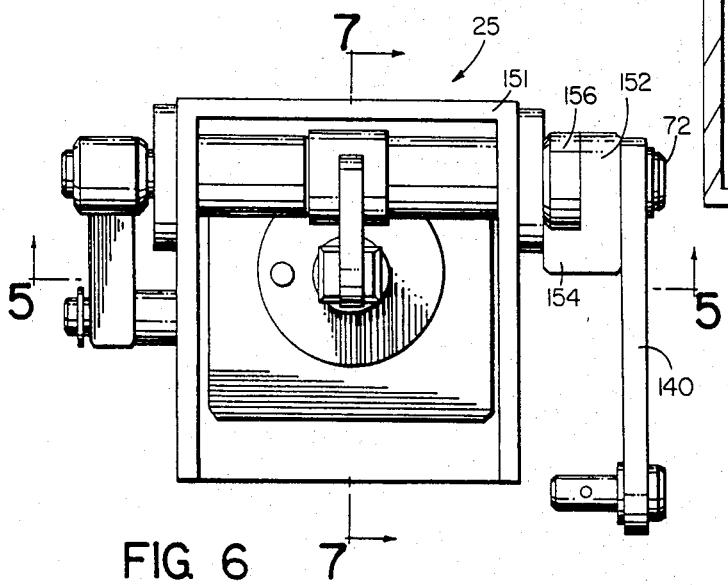
FIG. 6 is a top view of the unit of FIG. 5.

Referring to FIG. 5, the unit 25 includes a body 110 to which the three lines 38, 60 and 74 are connected by suitable fittings. The body includes a main bore 112 receiving a vertically slidable valve member 114 which extends between an outlet chamber 116 at the body's lower end and an upper chamber 118 at its upper end. The valve member 114 is urged downwardly by a spring 120 in the upper chamber 118 and the upper end of the spring is received in a plunger 122 vertically slidable in the chamber 118.

The valve member 114 has a vertically extending central passageway 124 extending from the bottom of the member, terminating at a point near the upper end of the member and having a transversely extending portion or port 126 at its upper end communicating with the outer cylindrical surface of the member 114. On its outer surface and about midway between its ends, the member 114 has a reduced diameter portion providing an annular chamber 128, and extending downwardly from this reduced diameter portion is a valving slot 130 which communicates at its upper end with the annular chamber 128.

The internal fluid connections include a passageway 132 connecting the delivery line 38 to the annular chamber 128 and another passageway 134 connecting the return line 74 to the upper chamber 118. The outlet line 60 is directly connected to the outlet chamber 116. Also, the spring plunger 122 has a reduced diameter portion 136 between its opposite ends and the chamber so formed is vented to the manifold by the line 138 so that manifold vacuum will withdraw any fuel which leaks into the annular chamber 136, thereby preventing it from passing to the upper end of the plunger and leaking into the atmosphere.

The control unit 25 is essentially a force balance device broadly similar to the metering pressure regulator 23 except that the spring force is variable. In operation, fuel enters the unit by way of the line 38 at a pressure of about 65 to 70 p.s.i. and fills the annular chamber 128 surrounding the valve member 114. If pressure in the outlet chamber 116 is such that the device is in the "fill" mode, the valve member 114 will be positioned downwardly from the position shown in FIG. 5 to a point such that the admission slot 130 communicates with the outlet chamber 116 permitting fuel to flow from the annular chamber 128 to the outlet chamber. It will be understood that in this "fill" mode the force of the spring 120 in comparison with the force exerted on the lower end of the valve member 114 by the fluid in the outlet chamber 116 is such as to hold the valve member 114 in the down or "fill" mode position.

As pressure in the outlet chamber 116 increases due to the flow of fuel from the annular chamber 128 to the outlet chamber the force on the lower end of the valve member 114 progressively overcomes the downward force of the spring 120 and urges the valve member 114 upwardly in the bore 112. As the "set" pressure dictated by the spring 120 is reached, the admission slot 130 fully enters the bore 112 to seal off any further ingress of fuel to the outlet chamber 116.

Simultaneously with the closing off of the admission slot 130 by the uwpard movement of the valve member 114, the upper port 126 of the valve member is moved out of the bore 112 to bring it into communication with the upper chamber 118, and therefore through the passageway 124 establishing communication between the outlet chamber 116 and the upper chamber 118. Since the upper chamber 118 is connected to the return line 74 this communication relieves the pressure in the outlet chamber 116.

In any steady state condition the valve member 114 therefore will "hover" between the fill and spill modes—the fill mode being the mode at which the delivery line 38 communicates with the outlet chamber 116 through the admission port 130 of the valve member and the spill mode being the mode at which the return line 74 communicates with the outlet chamber through the upper port 126 of the valve member—thus maintaining a controlled pressure in the outlet chamber 116 the value of which is dictated by the pressure exerted by the spring 120 on the upper end of the valve member.

An important feature of the unit 25 is that the pressure in the outlet chamber 116, and supplied to the line 60, is variable by varying the spring force exerted on the valve member 114. This spring force is varied by movement of the control shaft 72 which in turn is movable by a lever 140 moved in response to movement of the accelerator pedal, as by a flexible cable 142 connected to the pedal. The control shaft 72 has fixed to it a lever 146 with an actuating pin 148 pivotally connected to its outer end and engaging the upper end of the spring plunger 122. Rotation of the shaft 72 rotates the lever 146 causing the actuating pin 148 to vary the position of the spring plunger 122 and to accordingly vary the preload force the spring 120 exerts on the valve member 114 to consequently vary the pressure in the outlet chamber 116.

Figure 8:
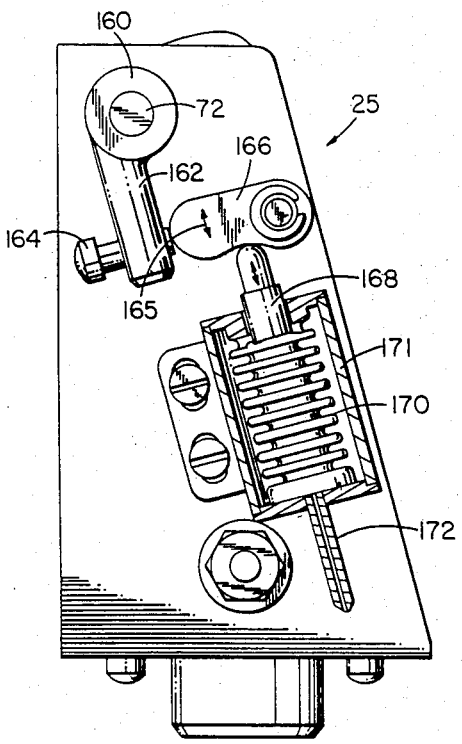
FIG. 8 is a left-side view of the unit of FIG. 5 with portions of the bellows unit being shown in section.
Figure 10:
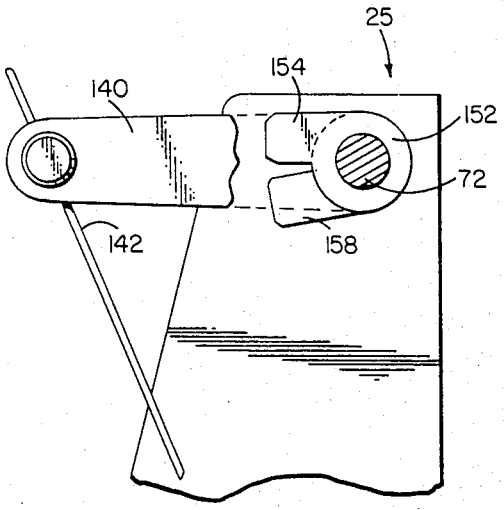
FIG. 10 is a fragmentary left-side view of the unit of FIG. 5 with a portion of the control lever being shown broken away to reveal the cold idle stops which are shown in their cold idle positions.
Figure 11:
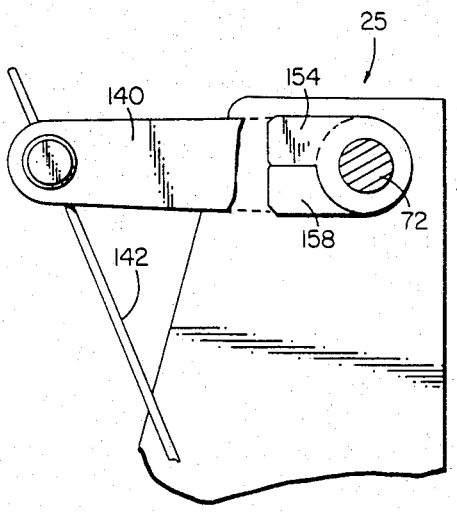
FIG. 11 is a view similar to FIG. 10 but shows the cold idle stops in their curb idle position.

The shaft 72 is rotatably received in two tubular spacers 150, 150 carried by a bracket 151 which also supports the body 110. The lever 140 is loosely received on the control shaft 72 and has fixed to it a collar 152 with a stop 154. Cooperating with the collar 152 is another collar 156 (FIG. 6) fixed to the shaft 72 and having a stop 158 (FIGS. 10 and 11). Fixed to the left-hand end of the shaft 72, as best seen in FIG. 8, is another collar 160 having an arm 162 carrying a cold idle adjust screw 164. The free end of the screw 164 bears against a cold idle cam 166, pivotally movable as shown by the arrow 165, the position of which is controlled by the plunger 168 of a bellows 170 received in a fluid tight housing 171 connected to a capillary tube 172 connected at its opposite end to a heat sensing bulb (not shown). As viewed in FIG. 8 the lower end of the plunger is fixed to the lower end of the bellows and the plunger extends slidably through the upper end of the bellows so that when the bellows is compressed the plunger is extended—that is moved upwardly.

When a cold start is made and the accelerator pedal 62 is immediately released, there is a risk of stalling if the engine speed is allowed to drop to the normal "curb idle". To prevent such stalling, the unit 25 has a cold idle feature to provide increased output pressure from the unit at the relaxed position of the accelerator pedal if the engine is cold. That is, when the accelerator pedal is released after a cold start the idle feature prevents the control shaft 72 from returning all the way to the curb idle position and consequently the pressure exerted by the spring 120 on the valve member 114 is kept somewhat higher than for the curb idle position until the engine warms up. This cold idle feature includes the bellows 170 and the associated cold idle cam 166 and collar 160. The bellows 170, the capillary tube 172, and the sensing bulb (not shown) connected to the far end of the capillary tube are filled with a suitable heat-sensitive fluid. The sensing bulb is mounted in the coolant jacket of the engine. As coolant temperature increases after starting the engine, expansion of the heat-sensitive fluid compresses the bellows and extends the plunger 168 to rotate the cold idle cam 166 in the clockwise direction as viewed in FIG. 8.

FIG. 10 shows parts in the positions corresponding to a cold idle condition. In this case the lever 140 is in the position corresponding to the relaxed or non-depressed condition of the accelerator pedal, but due to the contact of the cold idle adjust screw 164 with the cold idle cam 166 the control shaft 72 is prevented from moving entirely to the curb idle position and is instead held at the cold idle position at which the arm 154 fixed to the lever 140 is angularly spaced from the cooperating arm 158 fixed to the control shaft. As the engine warms up and the plunger 168 of the bellows extends the resultant movement of the cold idle cam 166 allows the control shaft 172 to move clockwise as seen in FIG. 10 until the stop 158 engages the stop 154 thereby establishing the curb idle position of the shaft 72. If the engine is cold, this cold idle feature provides a slightly higher fuel delivery to the fuel intake manifold than is normal for the corresponding position of the throttle plate 70 and therefore enriches the air/fuel mixture until the engine becomes warm. After the engine is warmed, the fuel delivery to the intake manifold is trimmed to the correct value for the curb idle speed—that is, the temporary fuel enrichment is canceled.

Figure 9:
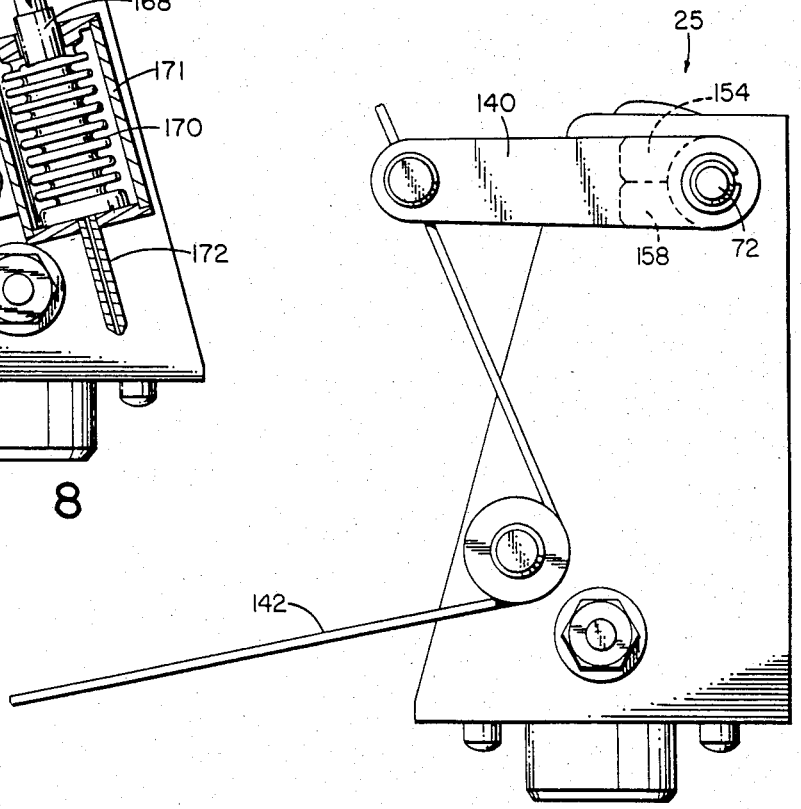
FIG. 9 is a right-side view of the unit of FIG. 5.

Of course, when the accelerator pedal 62 is depressed, this rotates the lever 140 away from the position shown in FIGS. 9, 10 and 11 causing a rotation of the shaft 72 and a compression of the spring 122 to increase the spring force on the valve member 114 and to thereby increase the pressure appearing in the outlet chamber 116 and in the outlet line 60. Further the pressure resulting in the output chamber 116 will be directly dependent on the degree of accelerator pedal depression, the pressure increasing with increases in the degree of pedal depression. In particular, the spring 120 and other portions of the unit 25 are so designed that the output pressure in the chamber 116 is infinitely variable between about 16 p.s.i. corresponding to the fully relaxed or idle position of the accelerator pedal and 52 p.s.i. corresponding to full depression of the accelerator pedal.

Figure 12:
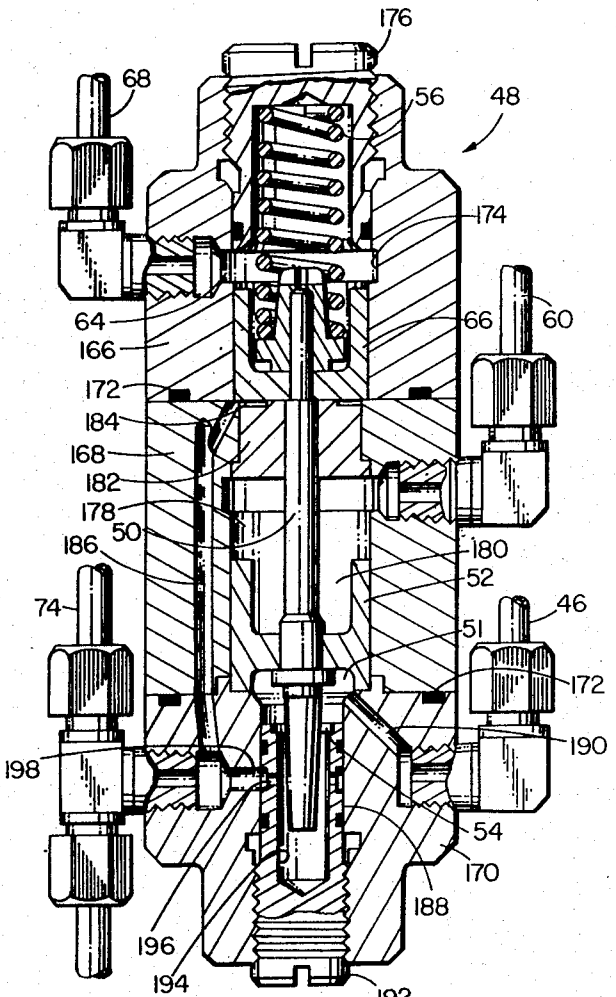
FIG. 12 is a vertical sectional view taken through the control pressure regulator of FIG. 2.

Control Pressure Regulator—FIG. 12

The basic parts and functions of the control pressure regulator 48 have already been described above in connection with the general organization of the system. FIG. 12, however, shows the regulator 48 in larger scale than the showing of FIG. 2 and makes apparent more of its details. Referring to FIG. 12 for a discussion of these details, the unit 48 has a body comprised of three parts 166, 168 and 170 held together by a number of threaded fasteners (not shown) and sealed by seals 172, 172. The upper part 166 contains a bore 174 slidably receiving the upper piston 66 and defining the vacuum chamber 64 to which the vacuum line 68 is connected. This bore also receives the spring 56 which is held in the body part 166 by a threaded cap 176.

The center body part 168 has a bore 178 slidably receiving the lower piston 52 and providing a chamber 180 above the piston 52 receiving fuel at the "biasing" pressure from the control unit 25 through the line 60. The lower and upper pistons 52 and 66 are both fixed to the valve member 50. At the upper end of the bore 178 in the middle body part 168 is a plug 182 fixed to the body part 168 through which the valve member 50 slidably passes, and a chamber 184 is formed between the upper face of the plug 182 and the lower face of the upper piston 66. This chamber communicates with the return line 74 through an internal passageway 186, formed in part in the middle housing part 168 and in part in the lower body part 170, so that the lower face of the piston 66 is at all times exposed to the vent or tank pressure of the return line 74.

The lower body part 170 has a bore 188 in part defining the chamber 51 to which fuel from the regulating line 46 is conducted through a passageway 190. The bore 188 also receives an orifice member 192, threadably connected with the body part 170 and having a bore 194 of its own in its upper portion which bore partially receives the tapered lower end of the valve member 50 and at its upper end defines the orifice 54. Below the orifice 54 the bore 194 has a lateral port 196 providing communication with a passageway 198 in the body part 170 in turn communicating with the return line 74. By threading the orifice member 192 into and out of the body part 170 the spill area of the orifice—that is, the area between the orifice and the tapered lower end of the valve member 50 may be varied for any given vertical position of the valve member 50 to achieve a desired performance from the regulator 48.

Figure 13:
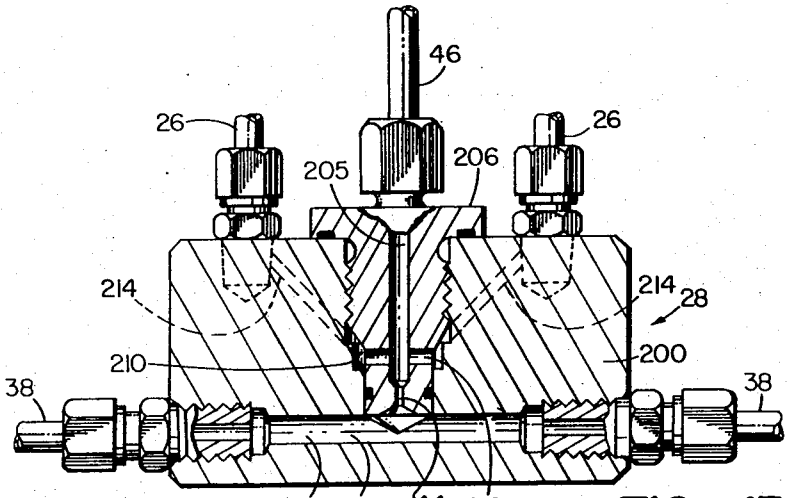
FIG. 13 is a sectional view taken on the line 13—13 of FIG. 2 through the control pressure distributor.
Figure 14:
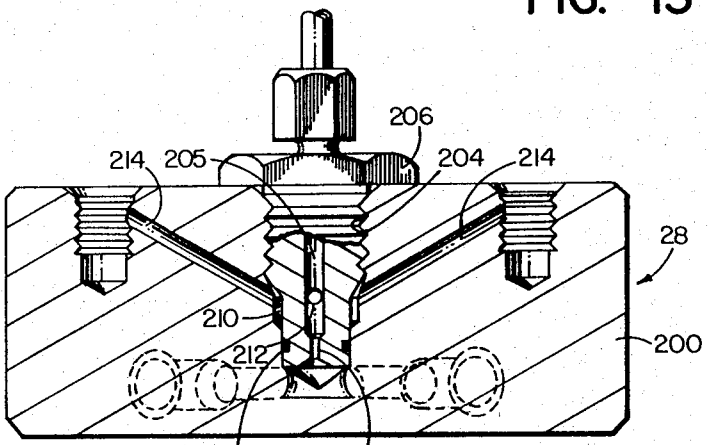
FIG. 14 is a sectional view taken on the line 14—14 of FIG. 2 through the control pressure distributor.

Control Pressure Distributor—FIGS. 13 and 14

As shown in FIGS. 13 and 14 the control pressure distributor 28 consists essentially of a body block 200 having a passageway 202 extending therethrough between opposite side faces and to opposite ends of which passageway 202 portions of the high pressure supply line 38 are connected so that the passageway 202 in effect becomes a part of the high pressure line 38. The passageway also constitutes the input chamber 40 shown in FIG. 1. In the center of the block 200 is a bore 204 communicating at its lower end with the passageway 202 and an orifice member 206 having the orifice 44 in its lower end. Above the orifice 44 the member 206 includes a central bore 205. The very lower end portion of the member 206 fits into a correspondingly diametered portion of the block bore 204 and is sealed to the block by an annular seal 208. Somewhat above the seal 208 the block bore 204 is of larger diameter than the associated portion of the orifice member 206 so as to define an annular chamber 210. The bore 205 and the annular chamber 210 are connected to one another through a transverse port 212 in the member 206, and the bore 205 and the chamber 210 together comprise the control pressure chamber 42 of FIG. 1. Communicating with the chamber 210 are four inclined passageways 214 each of which leads to a respective one of the control pressure lines 26, 26 connected to the block 200 through a suitable fittings. Also, the orifice member bore 205 leads to the top of the member and is there connected to the regulating flow line 46 through another suitable fitting.

From the foregoing, it will be understood, as previously described in connection with FIGS. 1 and 2, that high pressure fluid in the passageway 202 (comprising the chamber 41) will flow through the orifice 44 and, because of the pressure drop across the orifice, will produce a reduced pressure in the chamber 210, the bore 205 and the passageways 214, and subsequently in the control pressure lines 26, 26 connected with the passageways 214, 214, with such pressure being dependent on the rate of flow of fuel from the bore 205 through the regulating flow line 46.

Figure 15:
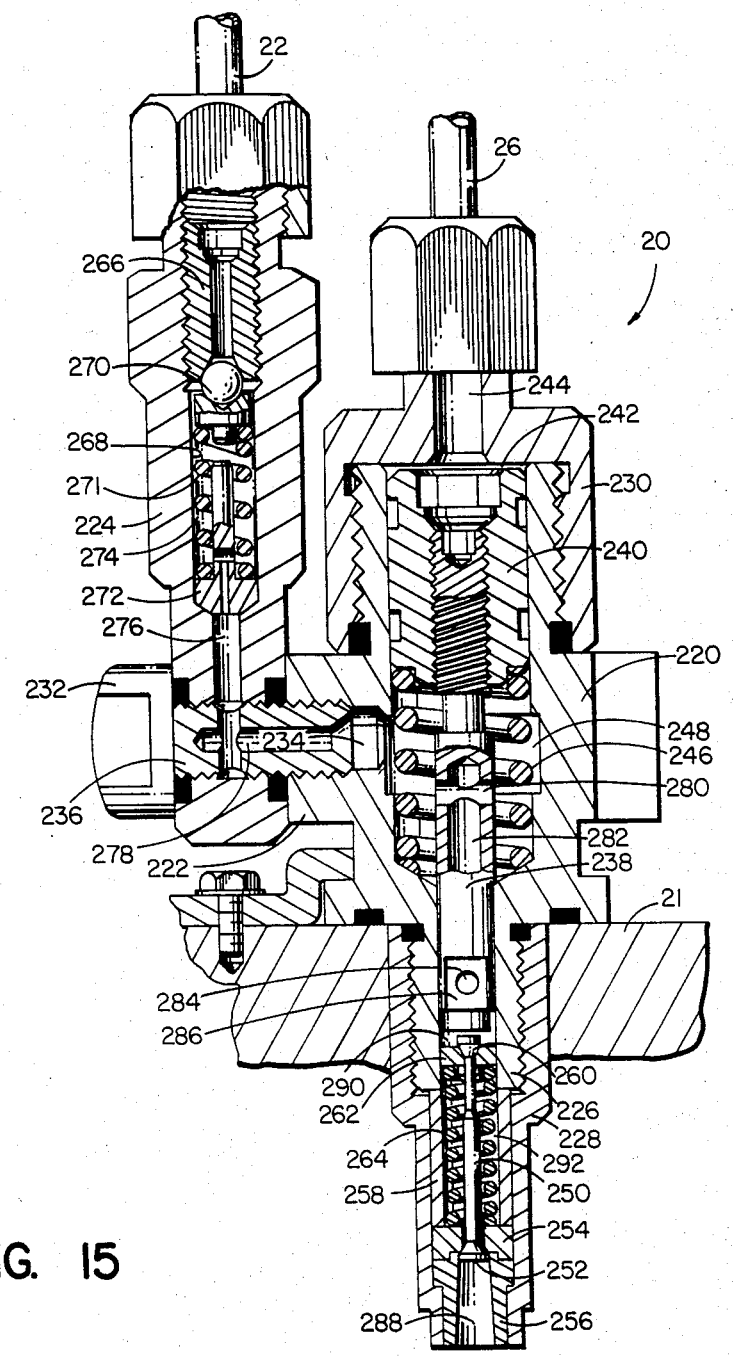
FIG. 15 is a vertical sectional view taken through one of the metering units of FIG. 2.

Metering Unit—FIG. 15

As mentioned above the purpose of each fuel metering unit 20 is to control the rate of fuel admission to an associated air duct feeding an associated cylinder of the engine. In FIG. 15 the illustrated metering unit 20 is shown installed in a portion of the engine which may be taken to be a cylinder head 21.

The metering unit 20 of FIG. 15 includes a main body 220 having a laterally extending stem 222 to which is fastened a fuel inlet body 224. The main body 220 at its lower end has a downwardly extending nose portion 226 to which is threadably connected a discharge body 228. The upper end of the main body 220 threadably receives a connector cap 230 through which the unit is connected to the associated control pressure line 26. The fuel inlet body 224 is held to the outer end face of the main body lateral stem 222 by an inlet stud 232 threadably connected at its inner end with a lateral bore 234 in the stem 222 with the shank of the inlet stud 232 passing through an opening 236 in the lower end of the fuel inlet body 224.

The main body 220 has a central vertical bore which slidably receives a vertically movable reach pin 238. Fixed to the upper end of the reach pin is a piston 240 the upper face of which defines in part a chamber 242 connected to the control pressure line 26 through a passageway 244 in the cap 230. The lower face of the piston 240 is engaged by a spring 246 which urges the piston, and the attached reach pin 238 upwardly to the positions shown in FIG. 15 and which yieldingly resists their movement downwardly away from such positions. The spring 246 is located in a chamber 248 formed by a portion of the body bore.

Immediately below but unconnected with the reach pin 238 is a vertically extending valve member 250. This member has a conical head 252 on its lower end which cooperates with a corresponding valve seat formed in an annular seat member 254 retained in the lower end of the discharge body 228 between two sleeves 256 and 258 in the bore of the discharge body 228. The lower sleeve 256 is restrained against downward movement from the position shown by coengaging annular shoulders on it and the discharge body 228; and the upper sleeve 258 extends between the valve seat member 254 and the lower end of the main body nose portion 226. The upper end of the valve member has another enlarged head 260 engaged by a spring retainer 262. A spring 264 in turn surrounds the major portion of the valve member 250 and works between the seat member 254 and the retainer 262 to urge the valve member 250 upwardly to the position shown in FIG. 15 at which its lower head 252 sealingly engages the seat of the seat member 254. Below the seat member 254 the sleeve 256 has a slightly tapered or frusto-conical bore which increases in diameter in moving downwardly from the seat 254.

The inlet body 224 includes a seat member 266 threaded into the upper end of its bore 268 to provide a downwardly facing seat for a ball check valve element 270. The valve element is in turn biased upwardly toward sealing engagement with the seat by a spring 271 the lower end of which is supported by a support member 272 having passageways therethrough providing communication between the chamber 274, located below the ball 270, and passageways 276 and 278 in the inlet body 224 and in the stud 232 leading from the chamber 274 to the chamber 248 in the main body 220.

Having in mind the above description of the construction of the metering unit 20 of FIG. 15, its operation and further details may now be described as follows. Fuel to be injected is admitted through the line 22 to the upper end of the inlet body at a constant pressure of 40 to 45 p.s.i. From here it passes through the check valve provided by the ball 270 and lifts the ball from its seat against the force of the spring 271. From this check valve the inlet fluid flows through the passages in the member 272 and through the passageways 276 and 278 to the chamber 248 which serves as a supply reservoir. From the chamber 248 the fluid next flows through an upper transverse passageway 280, a longitudinal passageway 282 and a lower transverse passageway 284 of the reach pin to two flats (only one of which is shown in FIG. 15 at 286) and from there into the chamber 290 surrounding the upper end of the valve member 250. There is clearance between the spring retainer 262 and the body bore in which it is received so that the fuel after entering the chamber 290 moves downwardly into the chamber 292 containing the spring 264. Further, the opening in the seat member 254 is of larger diameter than the portion of the valve member which it surrounds so that fluid flows downwardly from the spring chamber 292 to the enlarged head 252 on the lower end of the valve member. However, when the engine is stopped the head 252 sealingly engages the seat member 254 to prevent passage of fuel therebeyond and to thereby seal the fuel within the metering unit so as to prevent drainage of fuel from the system at this point.

To allow the enlarged lower head 252 of the valve member to seal firmly on the seat member 254 a gap is established between the upper head 260 and the lower face of the reach pin 238 when the reach pin and the valve member are in their uppermost positions corresponding to a stopped engine condition.

When the engine is running, the valve member 250 is held downwardly from the FIG. 15 position by the reach pin 238 to displace the enlarged bottom head 252 from the seat member 254. This displacement of the head 252 provides an open flow path from the chamber above the seat 254 to the tapered outlet bore 288 located below the head 252 and accordingly allows fuel to spray continuously from the bore into the associated air stream. The rate at which fuel is so sprayed depends on the location of the enlarged head 252 in the tapered bore, the lower the head the greater the effective discharge orifice and the greater the rate of discharge. The position of the head 252 is in turn determined by the magnitude of the control pressure supplied by the control pressure line 26 and appearing in the chamber 242 to create a downward force on the piston 240 opposed by the spring 246. The higher the pressure in the chamber 242 the farther the piston 240, the reach pin 238 and the valve member 250 are pushed downwardly from their uppermost positions. It will, of course, be understood that as the reach pin 238 first starts to move downwardly from the uppermost position shown in FIG. 15 it closes the gap between it and the valve member 250 and thereafter moves the valve member 250 downwardly with it. As soon as the valve member 250 is so engaged by the reach pin 238 the spring 264 assists the spring 246 in resisting the downward force exerted on the piston 240 by the control pressure in the chamber 242.

Preferably, and as shown in FIG. 15, the upper end of the reach pin 238 is threadably connected with the piston 240. This makes it possible to adjust individual metering units to equalize the discharge from all of the units making up a given set, such as the set of four units used with one four-cylinder engine as in FIGS. 1 and 2. For example, if one metering unit in a set consistently delivers more fuel than the others, its rate of discharge can be reduced by increasing the gap between its reach pin's lower end and the associated valve member 250, and this in turn can be accomplished by threading the reach pin 238 further into the piston 240 thereby reducing its extension downwardly beyond the lower face of the piston. Of course, the adjustment can also be made in the opposite direction—threading the reach pin somewhat out of the piston to reduce the gap and to thereby increase the rate of discharge. This adjustment capability also provides an easy way to compensate for the effect of possible tolerance "stack-up" among such features as the length of the spring 246, the length of the reach pin 238, and the length of the valve member 250.

As mentioned previously, the control pressure provided by the line 26 responds to the manipulation of the accelerator pedal 62 in such a way that depressing the pedal increases the control pressure and thereby increases the fuel flow from the metering unit by causing the reach pin 238 and the valve element 250 to be moved downwardly, thereby moving the enlarged head 252 on the lower end of the valve element to a less restricted position relative to the tapered bore 288 of the sleeve 256. When the accelerator pedal is retracted, a decay of control pressure ensues causing the piston 240, the reach pin 238 and the valve element 250 to move upwardly bringing the enlarged head 252 to a more restrictive position in the tapered bore 288 and thereby decreasing the flow of fuel to the associated air duct.

Also as previously mentioned, the pressure at which the fuel is delivered to the metering unit by the line 22 is maintained at a constant value of about 40 to 45 p.s.i. However, when the accelerator pedal 62 is depressed suddenly, it briefly increases the fuel pressure in the lower portions of the metering unit 20 by suddenly driving down the piston 240. This increase in pressure causes the check valve ball 270 to seat on its seat 266, trapping the fuel in the metering unit 20 and thereby holding the transient pressure surge therein. This temporary pressure surge in turn causes a brief increase in the rate of fuel delivery until the fuel pressure in the metering unit is again stabilized and the check valve 270 again opened.

Figure 16:
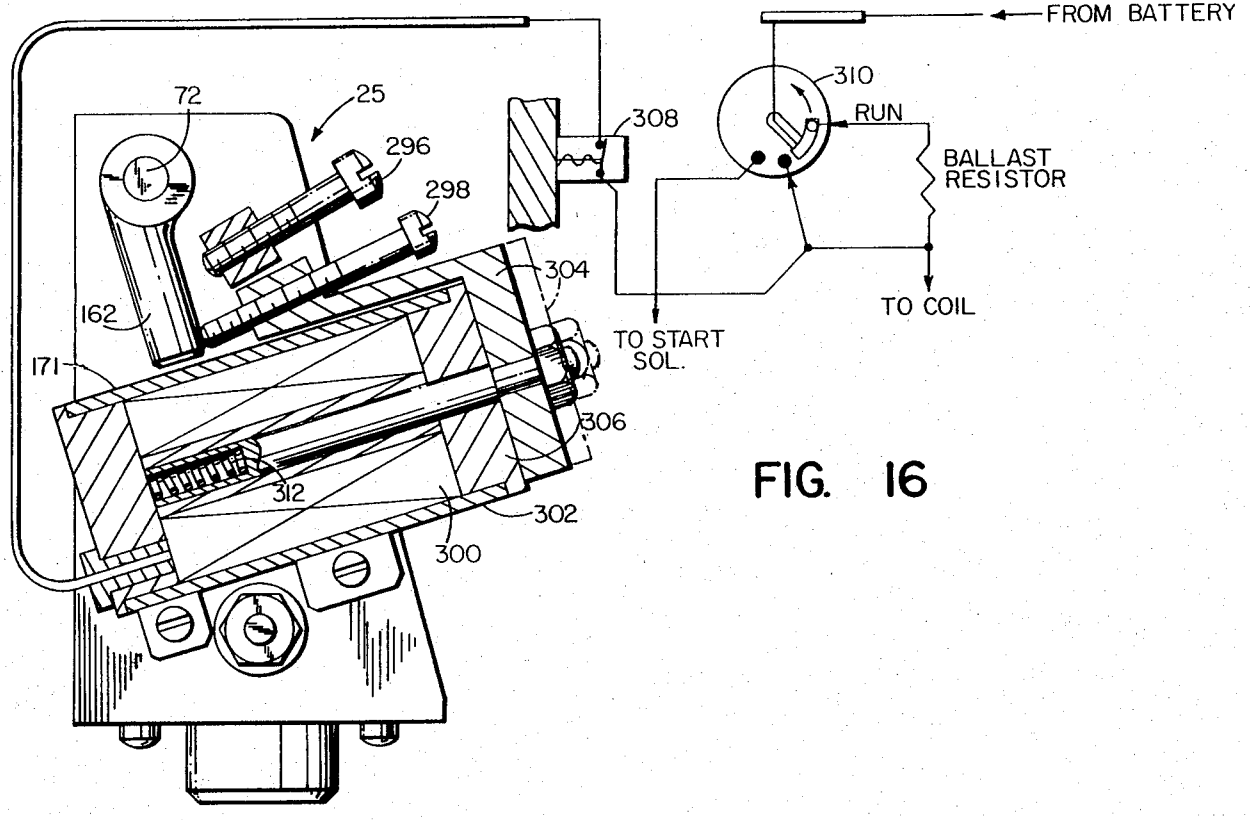
FIG. 16 is a view similar to FIG. 8 showing an alternative means on the accelerator position response pressure reducer for providing a cold idle feature.

Alternative Cold Idle Feature—FIG. 16

In the preceding discussion, FIGS. 8 to 10 disclose a means for obtaining a cold idle feature to provide increased output pressure from the unit 25 at the relaxed position of the accelerator pedal if the engine is cold, with such means including a temperature sensing and actuating system using a heat-sensitive fluid, sensing bulb and bellows. In place of that particular temperature sensing and actuating system other systems may be used without departing from the broader aspects of the invention, and FIG. 16 shows one such alternative system using an electrical sensor and actuator. Except for this electrical sensor and actuator the rest of the unit 25 is identical to that of FIGS. 5 to 11 and need not be redescribed.

Referring to FIG. 16, the unit 25 is equipped with a curb idle stop screw 296 and a cold idle stop screw 298. If the accelerator pedal is released immediately after starting a cold engine, the control shaft 72 and the idle stop arm 162 try to return to the curb idle position. However a coil 300 of a solenoid assembly 302 is energized at this time and magnetic attraction holds the associated armature 304 in contact with a head 306.

With the armature in this position, the fast idle stop screw 298 prevents the idle stop lever 162 and the control shaft 72 from returning fully to the curb idle position. Under these conditions the biasing pressure produced by the unit 25 is retained somewhat above the minimum value in the line 60 leading to the chamber 180 of the control pressure regulator 48.

In addition to this effect, when the accelerator pedal 62 is released, the air throttle plate 70 in FIGS. 1 and 2 can return immediately to the curb (low) idle position. This is made possible by the fact that the lever 140, as shown in FIGS. 9, 10 and 11, is loosely received on the control shaft 72 and is not constrained in any way from returning fully to its low idle position along with the air throttle plate 70.

Since the fast idle screw 298 prevents the shaft 72 and associated parts from assuming said low idle position, fuel delivery is not diminished as much as is air intake. This results in a richer fuel-air ratio which aids further in preventing stalling of a cold engine.

The solenoid coil 300 is energized through a thermostatic switch 308 when the ignition start-run switch 310 is engaged and the engine temperature is below 90 F. After cold starting, as engine temperature rises above this critical temperature, the thermostatic switch 308 opens and interrupts current to the solenoid coil 300, allowing the armature 304 and the cold idle stop screw 298 to retract.

This allows control shaft 72 and associated parts to retract also until the idle stop arm 162 contacts the curb idle stop screw 296, and the engine speed then drops to the curb idle value and the fuel-air ratio is corrected to warm conditions.

Figure 7:
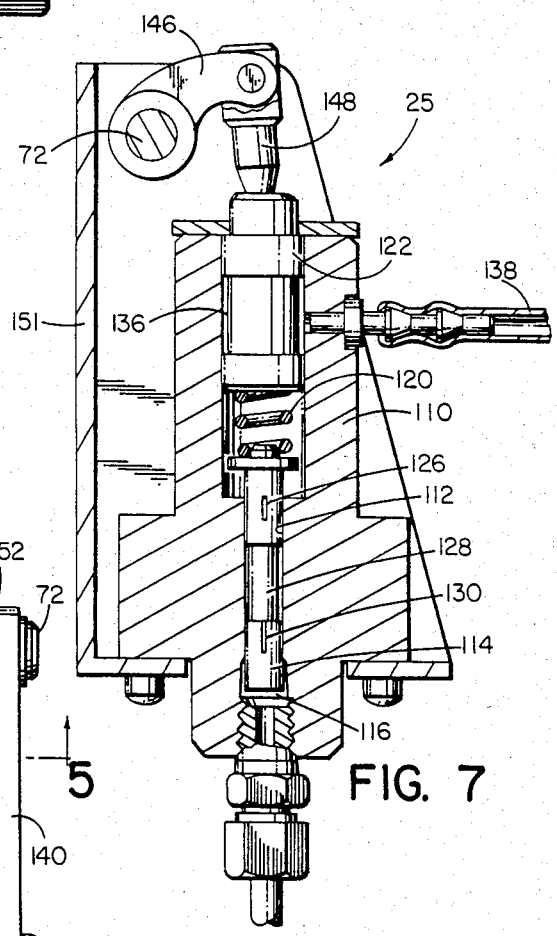
FIG. 7 is another vertical sectional view of the unit of FIG. 5 with this view being taken on the line 7—7 of FIG. 6.

When the circuit to the solenoid coil 300 is so interrupted by the thermostatic switch 308, movement of the solenoid armature 300 to the curb idle position is caused by a spring 312 in the armature 304 and also by the control spring 120, FIGS. 5 and 7, in the control unit 25.

I claim:

1. A continuous flow fuel injection system for an internal combustion engine having at least one combustion zone, said system comprising:

a metering unit for continuously injecting fuel into the air induction path for said one combustion zone, means for supplying injection fuel at a pressure which remains substantially constant for all operating conditions of the engine to said metering unit for said injection at said substantially constant pressure into said air induction path, and means for supplying control fuel to said metering unit independently of said supply of injection fuel and at a control pressure the value of which is dependent on engine requirements during normal running of said engine, so that during normal running of said engine said control pressure changes with changes in engine requirements, said metering unit including a valve member positioned in response to the value of said control pressure, and said metering unit being so constructed that the position of said valve member controls the rate of injection by said metering unit of said injection fuel without any of said control fuel being injected.

2. A continuous flow fuel injection system as defined in claim 1 further characterized by said metering unit including a body having a bore receiving a piston for vertical sliding movement, said body including an injection fuel chamber below said piston communicating with said valve member, a control fuel chamber above said piston, a reach pin fixed to said piston and extending downwardly therefrom into said injection fuel chamber for operating said valve element, and a spring in said injection fuel chamber urging said piston upwardly against the force imposed on it by the pressure of said control fuel in said control fuel chamber.

3. A continuous flow fuel injection system as defined in claim 2 further characterized by said valve member being a vertically elongated member having an enlarged lower head, a seat member fixed to said body and having an opening passing therethrough communicating with said injection fuel chamber and providing a generally downwardly facing seat surface cooperating with said enlarged lower head of said valve member, said enlarged lower head being located generally below said seat surface, the remainder of said valve member extending upwardly from said enlarged lower head through said seat opening and into said injection fluid chamber.

4. A continuous flow fuel injection system as defined in claim 3 further characterized by the upper end of said valve member being spaced from the bottom end of said reach pin when said piston and said reach pin are in their upwardmost positions, and a separate spring for urging said valve member upwardly relative to said seat member so as to urge said lower end of said valve member toward sealing engagement with said seat member.

5. A continuous flow fuel injection system for an internal combustion engine having at least one combustion zone, said system comprising:

a metering unit for continuously injecting fuel into the air induction path for said one combustion zone, means for supplying injection fuel at a pressure which remains substantially constant for all operating conditions of the engine to said metering unit for said injection into said air induction path, and means for supplying control fuel to said metering unit at a control pressure the value of which is dependent on engine requirements, said metering unit including a valve member positioned in response to the value of said control pressure and controlling the rate of injection by said metering unit of said injection fuel, said metering unit also including a body having a bore receiving a piston for vertical sliding movement, said body including an injection fuel chamber below said piston communicating with said valve member, a control fuel chamber above said piston, a reach pin fixed to said piston and extending downwardly therefrom into said injection fuel chamber for operating said valve element, and a spring in said injection fuel chamber urging said piston upwardly against the force imposed on it by the pressure of said control fuel in said control fuel chamber, said valve member being a vertically elongated member having an enlarged lower head, a seat member fixed to said body and having an opening passing therethrough communicating with said injection fuel chamber and providing a generally downwardly facing seat surface cooperating with said enlarged lower head of said valve member, said enlarged lower head being located generally below said seat surface, the remainder of said valve member extending upwardly from said enlarged lower head through said seat opening and into said injection fluid chamber, and means defining a tapered bore extending downwardly from said seat member and receiving said enlarged lower end of said valve member whereby an annular orifice is created between said enlarged lower head of said valve member and the surface of said bore, the area of which annular orifice increases as said valve member is moved downwardly to vary the rate of discharge of said injection fuel from said metering unit.

6. A continuous flow fuel injection system as defined in claim 2 further characterized by said means for supplying injection fuel including an injection fuel supply line connected to said metering unit, and said metering unit including a check valve between said injection fuel supply line and said injection fuel chamber for allowing fuel to flow from said injection fuel supply line to said injection fuel chamber and for preventing reverse flow of injection fuel from said injection fuel chamber to said injection fuel supply line.

7. A continuous flow fuel injection system as defined in claim 1 further characterized by a pump for withdrawing fluid from an associated tank and for pressurizing such fuel to supply it at a substantially constant high pressure to a high pressure supply line, said means for supplying injection fuel comprising a means for flowing fuel from said high pressure line and for reducing the pressure of the fuel so flowed to a lower injection pressure at which pressure the fuel is supplied to said metering unit as said injection fuel, and said means for supplying control fuel to said metering unit being a second pressure reducing means, separate from said first pressure reducing means, for flowing fuel from said high pressure line and for reducing the pressure of the fuel so flowed to said control pressure at which it is supplied to said metering unit as said control fuel.

8. A continuous flow fuel injection system for use with an internal combustion engine having an accelerator pedal and an intake manifold and at least one combustion zone, said system comprising:

a metering unit for continuously injecting fuel into the air induction path for said one combustion zone, means for supplying injection fuel at a pressure which remains substantially constant for all operating conditions of the engine to said metering unit for said injection into said air induction path, means for supplying control fuel to said metering unit at a control pressure the value of which is dependent on engine requirements, said metering unit including a valve member positioned in response to the value of said control pressure and controlling the rate of injection by said metering unit of said injection fuel, a pump for withdrawing fluid from an associated tank and for pressurizing such fuel to supply it at a substantially constant high pressure to a high pressure supply line, said means for supplying injection fuel comprising a means for flowing fuel from said high pressure line for reducing the pressure of the fuel so flowed to a lower injection pressure at which pressure the fuel is supplied to said metering unit as said injection fuel, and said means for supplying control fuel to said metering unit being a second pressure reducing means, separate from said first pressure reducing means, for flowing fuel from said high pressure line and for reducing the pressure of the fuel so flowed to said control pressure at which it is supplied to said metering unit as said control fuel, said second pressure reducing means including means for varying said control pressure both in response to the position of said accelerator pedal and to the vacuum in said intake manifold.

9. A continuous flow fuel injection system as defined in claim 7 for use with an engine having an accelerator pedal and an intake manifold and further characterized by said second pressure reducing means including a means providing a flow path with a fixed orifice through which fuel from said high pressure supply line flows, a control pressure regulator unit located in said flow path downstream of said orifice for controlling the rate of flow through said flow path and orifice to vary the pressure appearing in a control pressure portion of said flow path located between said orifice and said regulator unit which pressure in said control pressure portion of said flow path represents said control pressure, and means conducting fuel from said control pressure portion of said flow path to said metering unit as said control fuel.

10. A continuous flow fuel injection system for use with an internal combustion engine having an accelerator pedal and an intake manifold and at least one combustion zone, said system comprising:

a metering unit for continuously injecting fuel into the air induction path for said one combustion zone, means for supplying injection fuel at a pressure which remains substantially constant for all operating conditions of the engine to said metering unit for said injection into said air induction path, means for supplying control fuel to said metering unit at a control pressure the value of which is dependent on engine requirements, said metering unit including a valve member positioned in response to the value of said control pressure and controlling the rate of injection by said metering unit of said injection fuel, and a pump for withdrawing fluid from an associated tank and for pressurizing such fuel to supply it at a substantially constant high pressure to a high pressure supply line, said means for supplying injection fuel comprising a means for flowing fuel from said high pressure line and for reducing the pressure of the fuel so flowed to a lower injection pressure at which pressure the fuel is supplied to said metering unit as said injection fuel, said means for supplying control fuel to said metering unit being a second pressure reducing means, separate from said first pressure reducing means, for flowing fuel from said high pressure line and for reducing the pressure of the fuel so flowed to said control pressure at which it is supplied to said metering unit as said control fuel, said second pressure reducing means including a means providing a flow path with a fixed orifice through which fuel from said high pressure supply line flows, a control pressure regulator unit located in said flow path downstream of said orifice for controlling the rate of flow through said flow path and orifice to vary the pressure appearing in a control pressure portion of said flow path located between said orifice and said regulator unit which pressure in said control pressure portion of said flow path represents said control pressure, and means conducting fuel from said control pressure portion of said flow path to said metering unit as said control fuel, said second pressure reducing means including an accelerator position responsive pressure reducing unit operable to flow fuel from said high pressure supply line and in so doing to maintain fuel in an associated biasing fuel line at a reduced biasing pressure, and said control pressure regulator unit including means for controlling the rate of flow through said flow path and fixed orifice in response to both the value of said biasing pressure and the value of the intake manifold vacuum.

11. A continuous flow fuel injection system as defined in claim 10 further characterized by a return line for returning fuel to a tank, said control pressure regulator unit including a body receiving a vertically movable valve member having fixed to it upper and lower pistons, a spring urging said valve member downwardly relative to said body, said body having a vacuum chamber located above said upper piston receiving vacuum from said intake manifold, said body having a tank pressure chamber below said upper piston connected to said return line, said body having a chamber above said lower piston to which fuel at said biasing pressure is admitted, said body having a flow regulating chamber below said lower piston forming a serial part of said flow path, said valve element having a tapered lower end located in said flow regulating chamber, means defining an orifice surrounding said tapered lower end of said valve member at the lower end of said flow regulating chamber, and an outlet chamber located below said orifice and connected to said return line.

12. A continuous flow fuel injection system as defined in claim 11 further characterized by said first pressure reducing means and said accelerator position responsive pressure reducing unit both being fill and spill units wherein the pressure in an outlet chamber of the unit is maintained by parts continuously alternating between connecting said outlet chamber to said high pressure supply line and connecting said outlet chamber to said return line.

13. A continuous flow fuel injection system as defined in claim 10 further characterized by said accelerator position responsive pressure reducing unit having a piston, a spring urging said piston in one direction and the preload of which spring determines the value of the biasing pressure produced by said accelerator position responsive pressure reducing unit, a control shaft, and a lever fixed to said control shaft and operable on said spring for varying the preload of said spring in response to movement of said control shaft, a control lever loosely mounted on said control shaft, means for moving said lever about the axis of said control shaft in response to movement of said accelerator pedal, a pair of stops fixed respectively to said control lever and to said control shaft which stops are engageable to move said control shaft in the direction agaihst the force of said spring when said contrql lever is moved in one direction by depression of said accelerator pedal, a cold idle stop fixed to said control lever, a control idle cam movable into and out of a blocking position relative to said cold idle stop, and a thermostatic means for positioning said cold idle cam at said blocking position when the engine is cold and for moving it to a non-blocking position when the engine is warm.

14. A continuous flow fuel injection system for an internal combustion engine having at least one combustion zone, said system comprising:

a metering unit for continuously injecting fuel into the air induction path for said one combustion zone, means for supplying injection fuel at a pressure which remains substantially constant for all operating conditions of the engine to said metering unit for said injection at said substantially constant pressure into said air induction path, and means for supplying control fuel to said metering unit independently of said supply of injection fuel and at a control pressure the value of which is dependent on engine requirements, said metering unit including a valve member positioned in response to the value of said control pressure, said metering unit being so constructed that the position of said valve member controls the rate of injection by said metering unit of said injection fuel without any of said control fuel being injected, said metering unit including a body having a bore receiving a piston for vertical sliding movement, said body including an injection fuel chamber below said piston communicating with said valve member, a control fuel chamber above said piston, a reach pin fixed to said piston and extending downwardly therefrom into said injection fuel chamber for operating said valve element, and a spring in said injection fuel chamber urging said piston upwardly against the force imposed on it by the pressure of said control fuel in said control fuel chamber, said valve member being a vertically elongated member having an enlarged lower head, a seat member fixed to said body and having an opening passing therethrough communicating with said injection fuel chamber and providing a generally downwardly facing seat surface cooperating with said enlarged lower head of said valve member, said enlarged lower head being located generally below said seat surface, the remainder of said valve member extending upwardly from said enlarged lower head through said seat opening and into said injection fluid chamber, the upper end of said valve member being spaced from the bottom end of said reach pin when said piston and said reach pin are in their upwardmost positions, and a separate spring for urging said valve member upwardly relative to said seat member so as to urge said lower end of said valve member toward sealing engagement with said seat member, a tank, a suction line between said tank and said pump, a return line for returning fuel to said tank, said means for supplying injection fuel and said means for supplying control fuel together including at least one fill and spill control unit wherein the pressure in an outlet chamber of the unit is maintained by parts continuously alternating between connecting said outlet chamber to said high pressure line and connecting said outlet chamber to said return line, a check valve in said suction line, and a solenoid operated valve in said return line.

15. A continuous flow fuel injection system for an internal combustion engine having at least one combustion zone, said system comprising:

a metering unit for continuously injecting fuel into the air induction path for said one combustion zone, means for supplying injection fuel at a pressure which remains substantially constant for all operating conditions of the engine to said metering unit for said injection into said air induction path, and means for supplying control fuel to said metering unit at a control pressure the value of which is dependent on engine requirements, said metering unit including a valve member positioned in response to the value of said control pressure and controlling the rate of injection by said metering unit of said injection fuel, said metering unit also including a body having a bore receiving a piston for vertical sliding movement, said body including an injection fuel chamber below said piston communicating with said valve member, a control fuel chamber above said piston, a reach pin fixed to said piston and extending downwardly therefrom into said injection fuel chamber for operating said valve element, and a spring in said injection fuel chamber urging said piston upwardly against the force imposed on it by the pressure of said control fuel in said control fuel chamber, said valve member being a vertically elongated member having an enlarged lower head, a seat member fixed to said body and having an opening passing therethrough communicating with said injection fuel chamber and providing a generally downwardly facing seat surface cooperating with said enlarged lower head of said valve member, said enlarged lower head being located generally below said seat surface, the remainder of said valve member extending upwardly from said enlarged lower head through said seat opening and into said injection fluid chamber, the upper end of said valve member being spaced from the bottom end of said reach pin when said piston and said reach pin are in their upwardmost positions, and a separate spring for urging said valve member upwardly relative to said seat member so as to urge said lower end of said valve member toward sealing engagement with said seat member, and said reach pin being threadably connected to said piston at the upper end of said reach pin so as to allow the spacing between said bottom end of said reach pin and said upper end of said valve member to be adjusted by threading said reach pin somewhat into or out of said piston.

16. A continuous flow fuel injection system for an internal combustion engine having an accelerator pedal, an intake manifold and at least one combustion zone, said system comprising:

a tank, a return line to said tank, a pump for withdrawing fuel from said tank and for supplying it to a high pressure supply line at a substantially constant pressure, a spill and fill pressure reducing unit having said high pressure supply line as an inlet and an intermediate pressure line as an outlet for reducing the pressure of fuel flowing therethrough, from said high pressure supply line to said intermediate pressure line, to a substantially constant intermediate pressure in said intermediate pressure line, said pressure reducing unit also having said return line as an outlet through which fuel spilled in the operation of said unit is returned to said tank, a metering unit connected to said intermediate pressure supply line for injecting fuel from said intermediate pressure supply line into the induction air path for said combustion zone, said metering unit being responsive to the pressure of fuel supplied to a control pressure port to adjust the rate of its injection, and means for supplying fuel at a control pressure to said control pressure port of said metering unit, said means including a control unit for reducing the pressure of fuel derived from said high pressure supply line and appearing in a biasing line to a biasing pressure dependent on the position of said accelerator pedal, and a control pressure producing means for reducing the pressure of fuel flowing through a control pressure producing flow path from said high pressure supply line to said return line to a control pressure appearing in a control pressure portion of said flow path, said control pressure producing means including a fixed orifice in said flow path between said high pressure supply line and said control pressure portion, a variable orifice in said flow path between said control pressure portion and said return line, means for adjusting the size of said variable orifice in response to both the vacuum in said manifold and said biasing pressure, and means for supplying fuel from said control pressure portion of said path to said control port of said metering unit to create said control pressure at said control pressure port.

* * * * *